US005749437A

United States Patent [19]

Weller

[11] Patent Number: 5,749,437

[45] Date of Patent: May 12, 1998

[54] FREE-STANDING LADDER SUPPORTED TOOL HOLDER

[76] Inventor: Ronald K. Weller, 10615-Snyder Rd., San Diego, Calif. 91941

[21] Appl. No.: 626,519

[22] Filed: Apr. 2, 1996

[51] Int. Cl.[6] ..... B65D 85/00

[52] U.S. Cl. ..... 182/129; D25/68; 383/29; 248/97

[58] Field of Search ..... 182/129; 150/161; 206/373; D25/68; 2/80, 75, 247, 84, 79

[56] References Cited

U.S. PATENT DOCUMENTS

| | | | |
|---|---|---|---|
| D. 315,797 | 3/1991 | Cagle . | |
| D. 317,206 | 5/1991 | Cagle . | |
| 3,967,666 | 7/1976 | Farrar . | |
| 4,356,854 | 11/1982 | McGee . | |
| 4,365,397 | 12/1982 | Felpel . | |
| 4,706,918 | 11/1987 | Wilson . | |
| 4,726,446 | 2/1988 | Perbix . | |
| 4,773,535 | 9/1988 | Cook . | |
| 4,874,147 | 10/1989 | Ory et al. | 182/129 X |
| 5,012,963 | 5/1991 | Rosenbaum . | |
| 5,370,246. | 12/1994 | Traynor . | |
| 5,468,152 | 11/1995 | Lenart | 2/80 |
| 5,505,302 | 4/1996 | Ferley | 182/129 X |
| 5,542,553 | 8/1996 | Penniman | 182/129 X |

*Primary Examiner*—Alvin C. Chin-Shue
*Assistant Examiner*—Long Dinh Phan
*Attorney, Agent, or Firm*—Rothwell, Figg, Ernst & Kurz

[57] ABSTRACT

A non-obstructive tool holder which holds tools on a free-standing ladder, e.g. a step-ladder. The tool holder is configured so avoid obstruction of normal use of the free-standing ladder. The tool holder has a skirt including a front side sheet, a rear side sheet, a left side sheet, and a right side sheet connected together at sides thereof to form a generally tubular structure having a top opening and a bottom opening. The skirt narrows towards the top thereof. The front side sheet, the rear side sheet, the right side sheet, and the left side sheet each are made of a substantially flat but flexible material. The sides include pockets, and/or other supports, for holding tools. The top opening exposes the top platform of the ladder. A handle extends across the top opening, the bottom of the handle rests on the top platform of the free-standing ladder so that the top platform will remain unobstructed in normal use of the free-standing ladder. In addition, the front side sheet is shortening and includes an elastic portion whereby the use of the ladder is further unobstructed.

14 Claims, 3 Drawing Sheets

FIG. 3A
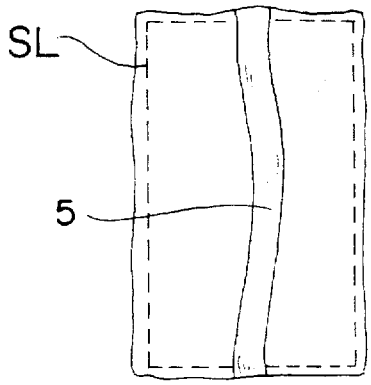
FIG. 3B
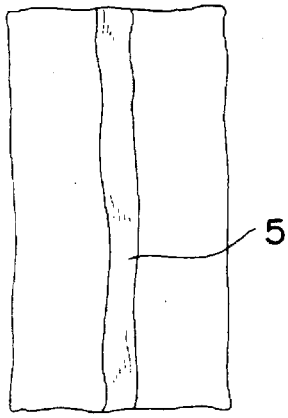
FIG. 3C
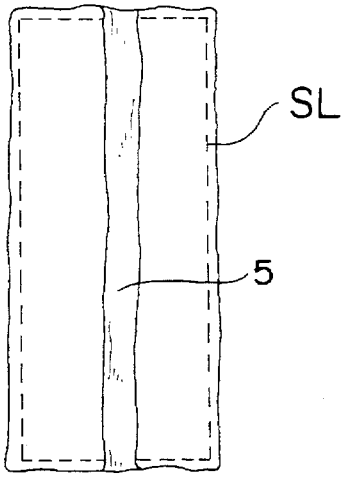
FIG. 4A
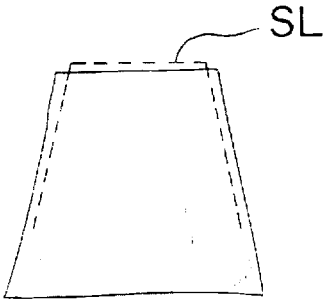
FIG. 4B
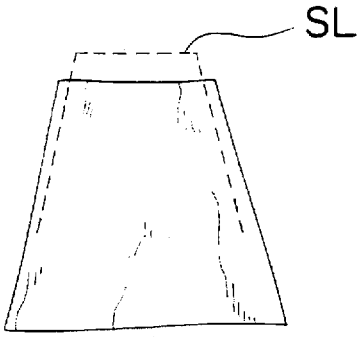
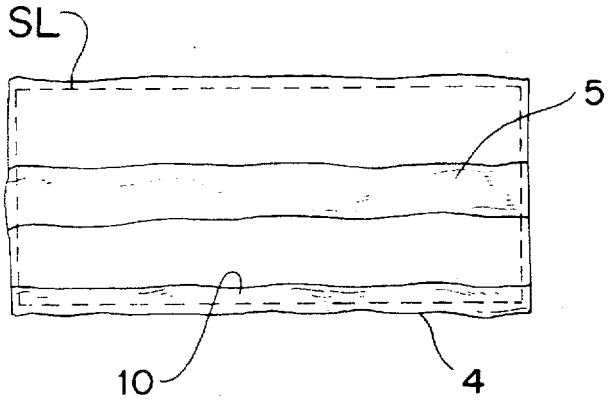
FIG. 5

FREE-STANDING LADDER SUPPORTED TOOL HOLDER

BACKGROUND OF THE INVENTION

The present invention relates to a tool holder fitted over the top, of a free-standing ladder, e.g. a portable step-ladder having a hinged supporting frame topped with a small platform. The present tool holder is an improvement upon the known devices and provides a more practicable and superior device.

1. The Related Art

A first known device is illustrated in U.S. Pat. No. 4,356,854 (McGee), and the present invention is an improvement over this device (the disclosure of this patent being incorporated by reference herein as noted below). The '854 patent shows a flexible tool holder for supporting tools on an free-standing ladder. The device includes a skirt 20 having side flaps 22, 23 extending below an upper base surface 16. In use, the base surface 16 rests on the top of a step-ladder. In addition, above the base 16 is provided a sidewall 14 which "has sufficient body to extend substantially vertically . . . " and a strap 26 is attached on opposite sides of the side wall 14.

A second known device is illustrated in U.S. Pat. No. Des. 317,206. The Des. '206 patent shows a tool holder which appears to fit over the top of a step-ladder. As shown, the holder has an upper base surface, see FIGS. 1, 5 and 6 and does not include an upper handle portion.

A third known device is illustrated in U.S. Pat. No. 4,773,535. The '535 patent shows a portable tool case which is fitted over a step-ladder. As shown, a top panel 72, which is "more of a structural panel than the vertical panels" is positioned over the top of the step-ladder. The top panel also includes a handle 82 attached thereto. This panels of this device include a stiffening material in order to increase the structural stiffness of the tool case, whereby this construction maintains a box-like integrity—even when removed and held by the handle.

2. Problems in the Related Art

Interference With Normal Use

First, when placed over a step-ladder, the related art interferes with the normal operation and use of the step-ladder. For example, each of the above-discussed patents show holders having a top base sheet which extends over the entire top of the step-ladder.

Accordingly, the top of the step-ladder is difficult, or impossible, to utilize for normal uses—such as placing one's hands or feet or an article thereon for support.

Because of such a top base sheet, utilization of the top of the step-ladder can result in the relative movement of the base sheet to the step-ladder.

In addition, stepping, or the like, upon the top of the step-ladder can result in damage to the base surface of the holder.

The first reference noted above, U.S. Pat. No. 4,356,854 (McGee), includes an upper compartment formed by the sidewalls 14. The upper compartment covers the top platform of the step-ladder, interfering with normal use of the step-ladder. In addition, the over-hanging handle 26 obstructs movement over the ladder—e.g. possibly snagging one's limb and/or an article.

Similarly, the handle 82 of third reference noted above, U.S. Pat. No. 4,773,535, extends upwards from the top surface, whereby resulting in similar difficulties. On the other hand, the second reference noted above, U.S. Pat. No. Des. 317,206, does not include a handle extending thereover—avoiding problems related to the presence of the handle, but resulting in further difficulties in portability of the structure.

Difficulties Adapting To Ladder Dimensions

The related art is not readily adapted to free-standing ladders of differing dimensions because of, among other things, the interlocked structure between the top base sheet and the side walls—which diminishes the availability of alternative configurations.

Other Problems

In addition to the above-noted problems discovered by the present inventor, the related art includes additional problems that will be more apparent after reviewing the present invention discussed below—such as, among other things, involving complicated structure and construction.

SUMMARY OF THE INVENTION

The present invention is an improvement upon the known devices and provides a more practicable and superior device. The various embodiments of the present invention solve the above and other problems noted in the art.

There is a competing interest between the desirability of providing an upper handle and the desirability of utilizing the top of the step-ladder without interference from such a handle. The present invention cleverly accommodates both of these interests while providing a relatively easy to manufacture product which can also be more easily adapted to step-ladders of differing sizes.

In this regard, according to a first aspect of the invention, a free-standing ladder tool holder is provided which includes: a skirt including a front side sheet, a rear side sheet, a left side sheet, and a right side sheet connected together at sides thereof to form a generally tubular structure having a top opening and a bottom opening; said skirt narrowing towards the top thereof, and said top opening having a smaller size than said bottom opening; said front side sheet, said rear side sheet, said right side sheet, and said left side sheet each being made of a substantially flat but flexible material; at least one of said front side sheet, said rear side sheet, said right side sheet, and said left side sheet having at least one pocket for holding a tool; said top opening being delineated by upper edges of each of said front side sheet, said rear side sheet, said right side sheet, and said left side sheet; a handle extending across said top opening and attached to said upper edges of either said front side sheet, said rear side sheet, said right side sheet, and said left side sheet, at opposite sides of said top opening, said handle being made of a substantially flat but flexible material; whereby when placed upon a free-standing ladder the top surface of the free-standing ladder can be exposed through the top opening and the handle can rest on a top platform of the free-standing ladder so that the top platform will remain unobstructed in normal use of the free-standing ladder.

According to another aspect of the invention, the free-standing ladder tool holder further includes that the height of front side sheet is substantially shorter than the height of each of said rear side sheet, said right side sheet, and said left side sheet.

According to another aspect of the invention, the free-standing ladder tool holder further includes that the front side sheet has an elastic member formed along the lower edge thereof so as to more snugly attach to the free standing ladder.

The present invention has substantial advantages over the other known tool holders.

A user can have ready access to several different types of tools at one time without obstruction of the normal use of the free-standing-ladder (thus, the present device reduces "lost labor" by providing easy access to needed tools and by enabling easy, unobstructed use of the free-standing-ladder).

In addition, the present invention is more readily adapted to free-standing ladders of differing dimensions.

Furthermore, the present invention involves an easily fabricated structure—reducing cost and time for construction.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention is illustrated by way of example and not limitation in the accompanying drawings, in which like references indicate like parts, and in which:

FIGS. 3A through 3C show explanatory top views of an adaptability aspect of the invention;

FIGS. 4A through 4B show explanatory top views of an adaptability aspect of the invention; and FIG. 5 shows a top view according to an alternative embodiment of the invention.

DETAILED DESCRIPTION OF THE DRAWINGS

Figure 1:
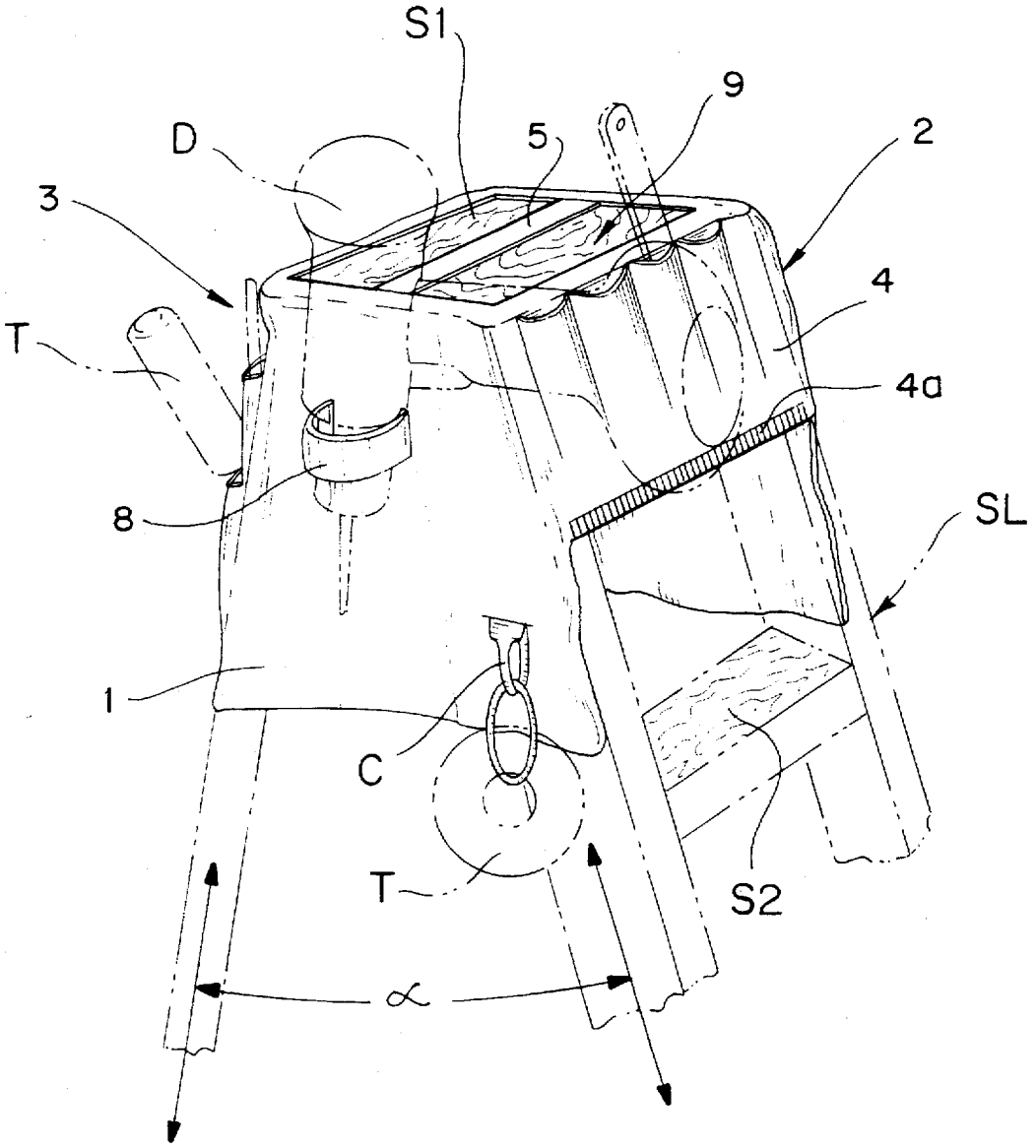
FIG. 1 shows a perspective view of a front left side of a first embodiment of the invention.
Figure 2:
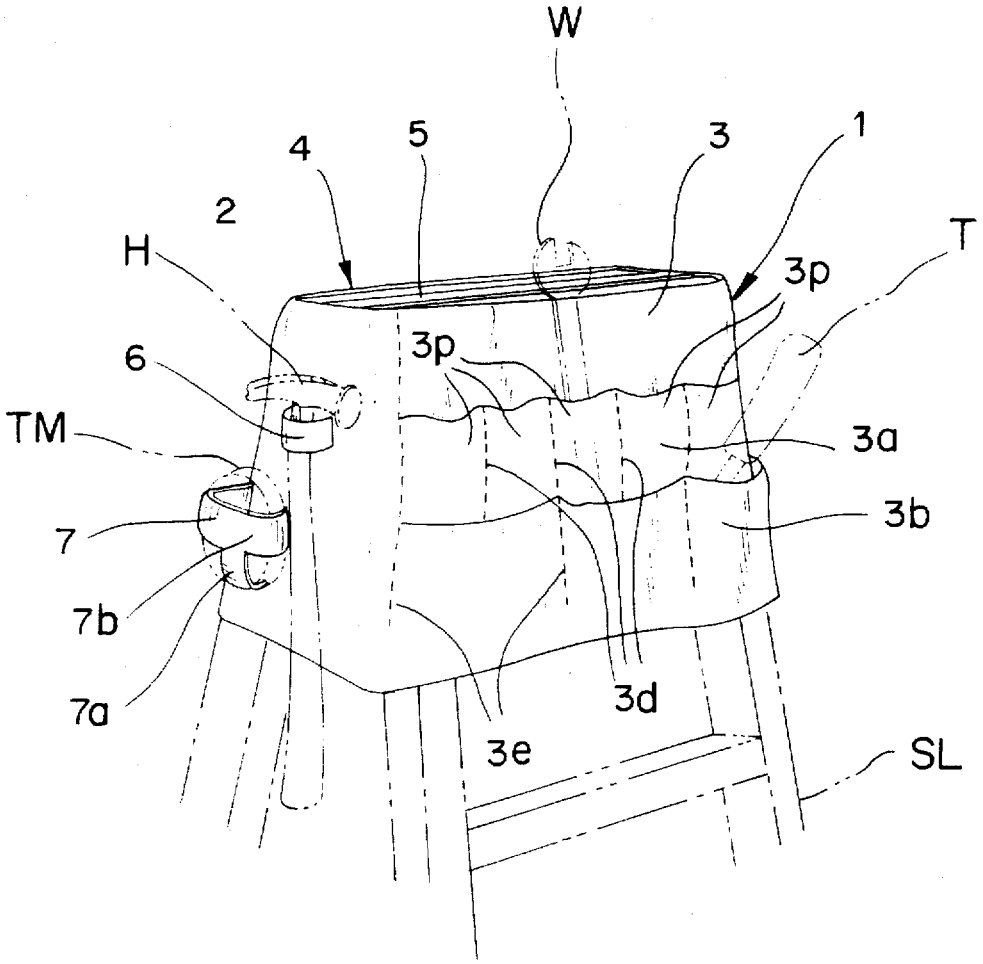
FIG. 2 shows a perspective view of a rear right side of the first embodiment shown in FIG. 1.

As shown in FIGS. 1 and 2, according to a first embodiment, the present device includes a skirt having two generally trapezoidal shaped left and right side sheets 1 and 2 and two generally rectangular rear and front side sheets 3 and 4.

The side sheets 1, 2, 3, and 4 are each attached to one another to form the skirt (e.g. a tube having a generally rectangular shaped horizontal cross-section) which is fitted over the upper end of a step-ladder SL. The side sheets 1, 2, 3, and 4 are preferably made from a generally flexible heavy duty fabric material such as canvas or the like. The side sheets can be separately cut and then sewn together, or more than one side sheet (or all) can be integrally cut from a single sheet.

The handle

Preferably, a handle 5 extends across the upper edge of the skirt between central portions of the upper edge of both trapezoidal left and right side sheets 1 and 2. When placed upon a step-ladder such as shown in FIG. 1, the handle 5 preferably rests substantially flat against the top support surface S1 of the step-ladder SL, whereby the handle 5 does not obstruct normal use of the step-ladder.

The handle 5 is preferably made from the same material as the side sheets. As a result, the handle easily rests substantially flat on the step-ladder. As illustrated, the handle 5 is preferably somewhat narrow such that a substantial portion of the top support surface S1 is exposed on either side of the handle. In the preferred construction, the handle extends between the left and right sides. However, it is contemplated that, although less preferred, the handle may be constructed to extend across the rear to front sides (a shorter distance). In this latter arrangement, the wider sides 3 and 4 would have less of a tendency to collapse inward, but would have more of a tendency to collapse outward when the device is lifted by the handle 5. Further, the handle 5, for stability, etc., preferably extends across substantially the center of the skirt; however, although clearly less preferred, it is contemplated that the handle may be located off center or proximate one of the sides.

The handle is preferably sturdy enough to allow easy removal, carrying and/or relocation of the work holder.

The front side sheet

As shown in FIG. 1, the front side sheet 4 is preferably made to be substantially shorter than the other side sheets 1, 2, and 3. In this regard, the vertical height of the front sheet is preferably such that the step support surface S2 of the top step of the stepping ladder SL can be accessed substantially without obstruction from the front side sheet 4.

For example, in one preferred construction, the work holder is sized so as to snugly fit over a step-ladder having: (1) an opened standing height of approximately 5 feet from the ground level to the support surface S1, (2) dimensions of the support surface S1 of about 1 foot long by 6 inches wide, and (3) a vertical distance between the step support surface S2 and the support surface S1 of about 1 foot. Accordingly, the dimensions of the side sheets can be sized accordingly. It is noted that between various step-ladders the standing height may vary considerably. However, this variation should not affect the dimensions notably—i.e. it may only slightly affect the angle at the apex of the ladder. In addition, the dimensions of the support surface as well as the distance between the surfaces S1 and S2 should not likely vary more than plus or minus about 3 to 4 inches. Regardless of the ladder size, in the preferred construction, the front side sheet 4 is sized to provide a sufficient distance above the support surface S1 to allow use thereof—or about 6 or more inches above the step support surface S1. Preferably, to appropriately fit common ladders and to accommodate an adequate amount of tools, while remaining portable and non-obstructive, the front sheet should be about 5–7 inches tall and the other side sheets should be about 10–14 inches tall.

In another alternative arrangement, the height of the front surface is made substantially smaller so as to maximize access to the support surface S2, e.g. only a few inches tall; however, for structural integrity of the device in use, etc., it is preferable to have a greater portion of the front sheet 4 attached to the side sheets.

It is noted that the shorter front sheet 4 also facilitates application of the device on step-ladders due to potential variation widths of the step-ladders. For example, the apex angle $\alpha$ (see FIG. 1) between the ladder side and the support side of the step-ladder SL may vary. That is, when the step-ladder has a greater apex angle, the further the distance below the surface S1, the greater the increase in width between the ladder side and the support side of the step-ladder SL. Accordingly, shortening the front side allows for slightly greater discrepancies.

As further shown in FIG. 1, the front side sheet 4 preferably includes an elastic member 4*a* horizontally attached along the lower edge thereof. The elastic member provides a snugger fit to the step-ladder and facilitates adaptation to different size ladders. Further, because the elastic member 4*a* is at a greater height, e.g. closer to the surface S1, a snugger fit is easier to maintain due to the narrower range in which the elastic portion is required to expand/contract.

In addition, the elastic member 4*a* on the front (i.e. ladder side) of the step-ladder helps to ensure that the fabric material above the step support surface S2 is snugly fit to the step-ladder. This helps to more surely prevent the front sheet 4 from obstruction of the support surface S2.

As shown in FIG. 1, the front side sheet 4 can also include pockets thereon. These pockets can, in a preferred construction, be made similar to those formed on the rear side sheet 3 (see the following paragraph). In an alternative arrangement, the front sheet 4 can be made without pockets so that no objects therein can interfere with use of the step-ladder.

The rear sheet

As shown in FIG. 2, the rear side sheet 3 preferably includes a plurality of pockets or other support members for holding tools and the like. The pockets or other support members can include, for example, any of those as disclosed in U.S. Pat. No. 4,356,854, the disclosure of which is incorporated herein by reference.

In the most preferred embodiment, as shown in FIG. 2, the pockets include a number of elongated pockets 3*p* extending generally vertically along the rear side sheet. The pockets can readily be formed by attaching a single canvas sheet 3*a* to the rear side wall sheet by a plurality of sewn together seam portions 3*d* at which the sheets 3*a* and 3 are sewn together. A similar second canvas sheet 3*b* can also be provided which is sewn at areas 3*e* to the sheets 3 and/or 3*a* in order to provide a second row of pockets. This construction enables a plurality of variously sized pockets to be easily fabricated with only a few sheets of material. As shown, preferably the upper pockets 3*p* are vertically elongated to vertically hold hand tools such as a wrench W, a screwdriver, chisel, etc. In addition, preferably the lower pockets formed by the second canvas sheet 3*b* are somewhat wider for accommodating non-elongated, or other, objects, such as nails, nuts, bolts, etc. In the preferred construction, the elongated pockets 3*p* overlap (i.e. extend behind) the pockets of the second canvas sheet.

The right side sheet

As further shown in FIG. 2, the right side sheet 2 preferably includes at least one loop member 6 which is sized to support a large hammer H, or the like. The loop member 6 is formed as an approximately cylindrical member having upper and lower openings, and the loop member is preferably sewn proximate an upper side of the sheet 2 such that the length of the hammer can rest against a substantial portion of the sidewall sheet 2. In addition, the right side sheet can include another holder member 7 which is constructed for easily holding a tape measure TM or the like. The holder member 7 is constructed by a first loop member 7*b* which extends generally horizontally in a similar manner to the loop member 6 and a second support member 7*a* which extends generally vertically below the member 7*b* and attaches to the side sheet 2 therebelow.

The left side sheet

As further illustrated in FIG. 1, the left side sheet 1 preferably includes a loop member 8 which is sized to fit a drill D therein. The loop member 8 can be similar in design to the loop member 6. The loop member 8 can also consist of a deeper, more pocket-like structure to support the drill therein, such as the side pockets 24 and 25 of U.S. Pat. No. 4,356,854, the disclosure of which, as noted above, is incorporated by reference (see, e.g., column 2, lines 15 to 27).

As also shown, in the preferred construction, the left side also includes a clip C for conveniently holding a roll of tape T.

The top opening

As shown in FIG. 1, the surface S1 is substantially exposed through the top opening 9 delineated by the uppermost edges of the sides 1, 2, 3 and 4.

According to a first embodiment, the sides 1 and 2 can be made from flat, trapezoid sheets and the sides 3 and 4 can be made from flat, rectangular sheets, and the sides can be sewn, or otherwise attached together, linearly along the side edges of the side sheets. In this manner, the holder, when supported such that each side is flat and at a 90 degree angle to the adjacent sides, is configured such that the sides 3 and 4 are at a constant angle from one another along the entire height thereof.

With such a construction, the holder can potentially be more readily adapted to conform to a particular step-ladder. In this regard, because of the top opening 9, the sides can be adapted, to some extent, to accommodate slightly shorter ladder tops and/or slightly longer ladder tops, such as shown in FIGS. 3A and 3C, respectively. In this regard, the handle 5 can be made to have an elastic region or have a certain elasticity to enable a small extension of the length of the handle 5 to better accommodate a longer ladder top.

Furthermore, the top opening 9, as so designed, can potentially allow for accommodation of a small portion of the upper edge of the step-ladder so as to better adapt to a variety of ladder sizes, e.g. to fit lower on a narrower/smaller ladder top as shown in FIG. 4B, but higher on a wider/larger ladder top as shown in FIG. 4A. Once again, having the handle 5 made to have an elastic region or have a certain elasticity to enable a small extension of the length thereof would facilitate this adaptability.

Nevertheless, in another preferred construction the holder is made such that an upper edge of at least one of the side sheets is curved inward to extend slightly over the top platform of the step-ladder. For example, as shown in FIG. 5, an inward projecting portion 10 formed by turning inward the top of the front edge 4, can be provided. This construction provides additional support on the side edges of the ladder top. Accordingly, this type of construction may lessen the adaptability shown in FIGS. 3A–3C and 4A–4B, but would provide additional support such that the handle 5 would not accommodate the entire weight of the holder and the contents held.

Operation and use

In use, the work holder can be placed over the top of the ladder SL such that it is fitted thereover with the handle 5 resting on the support surface S1 of the step-ladder. The rigid step-ladder enables the relatively flexible work holder to maintain a substantially constant shape due to its generally snug fit thereover; accordingly, tools, etc., can be well supported within the work holder.

If desired, one can utilize all of the steps of the ladder because the support surface S2 of the top step is accessible and because a substantial portion of the support surface S1 is also exposed.

Accordingly, one can place one's hands, knees, feet, etc., upon the support surfaces S1 and S2 more stably and reliably, such as for bracing oneself during use of a drill or other tool. Accordingly, the work holder does not interfere with the utilization of the step-ladder as do the other known work holders. In this regard, for example, with a typical 5 foot tall step-ladder, in order to stand upon even the lowermost steps, one typically uses his/her hands to balance by supporting at the upper step and/or top of the step-ladder. Thus, in contrast to the present device, the other known work holders even interfered with the use of the bottom-most steps of the step-ladder.

Furthermore, because the handle 5 is, preferably, made to rest upon the top surface S1, the handle does not extend upward to obstruct usage of the device and interfere with one' limbs, etc. Nevertheless, at the same time, the handle 5 is easily grasped by the hands of a user in order remove the work holder from the step-ladder. When the work holder is removed from the step-ladder and the device is held by the handle 5, although the left side 1 and the right side 2 may move towards one another due to flexibility of the material of the work holder, the tools still can remain within the holder for transport. Accordingly, the tools do not necessarily have to be replaced into the work holder each time the holder is transferred to a step-ladder.

It is noted that the various pockets on the tool holder should, preferably, hold the tools somewhat close against the step-ladder work holder; in this manner, the tools should not tend to lean outward in a manner to interfere with usage of the step-ladder or with transport of the tools in the work holder, when off of the step-ladder.

Advantages

The present invention, thus, provides an improved tool holder having many advantages over the other known tool holders.

For example, (a) the present tool holder securely holds tools on top of any standard size free-standing ladder; (b) a user can have ready access to several different types of tools at one time without obstruction of the normal use of the free-standing ladder (thus, the present device reduces "lost labor" by providing easy access to needed tools and by enabling easy, unobstructed use of the free-standing ladder); (c) the present invention is more readily adapted to free-standing ladders of differing dimensions; and (d) the present invention involves an easily fabricated structure—reducing cost and time for construction.

Other Embodiments

While the instant invention has been shown and described with specific reference to embodiments presently contemplated as the best mode of carrying out the invention in actual practice, it is understood that various changes may be made in adapting the invention to different embodiments without departing from the broader inventive concepts disclosed herein and comprehended by the claims which follow. As one example, although the preferred arrangements of pockets, clips, loops, etc., have been discussed (e.g pockets for larger objects such as drills and hammers, as per the preferred embodiments, are located on the left and right sides so as to be non-obstructive and easily grasped from a position on the ladder), it is contemplated that the various loops, clip, etc., can be alternatively arranged, such as on other side sheets than that discussed or shown in the figures.

What is claimed is:

1. In combination:

a) tool holder, comprising:

a skirt including a front side sheet, a rear side sheet, a left side sheet, and a right side sheet connected together at sides thereof to form a generally tubular structure having a top opening and a bottom opening;

said skirt narrowing towards the top thereof, and said top opening having a smaller size than said bottom opening;

said front side sheet, said rear side sheet, said right side sheet, and said left side sheet each being made of a substantially flat but flexible material;

at least one of said front side sheet, said rear side sheet, said right side sheet, and said left side sheet having at least one pocket for holding a tool;

said top opening being delineated by upper edges of each of said front side sheet, said rear side sheet, said right side sheet, and said left side sheet;

a handle extending across said top opening and attached to said upper edges of either said front side sheet, said rear side sheet, said right side sheet, and said left side sheet, at opposite sides of said top opening, said handle being made of a substantially flat but flexible material;

whereby when placed upon a free-standing ladder the top surface of the free-standing ladder can be exposed through the top opening and the handle can rest on a top platform of the free-standing ladder so that the top platform will remain unobstructed in normal use of the free-standing ladder;

b) a free-standing ladder having a hinged supporting frame topped with a top platform; and c) said tool holder being fitted over the top platform of said free-standing ladder with a lower surface of said handle resting on an upper surface of said top platform.

2. In combination of the free-standing ladder tool holder according to claim 1, wherein said handle has a length substantially equal to a distance across said top opening.

3. In combination of the free-standing ladder tool holder according to claim 1, wherein the height of front side sheet is substantially shorter than the height of each of said rear side sheet, said right side sheet, and said left side sheet.

4. In combination of the free-standing ladder tool holder according to claim 3, wherein the front side sheet includes an elastic member formed along the lower edge thereof so as to more snugly attach to the free-standing ladder.

5. In combination of the free-standing ladder tool holder according to claim 3, wherein the height of front side sheet is about 5–7 inches and the height of each of said rear side sheet, said right side sheet, and said left side sheets is about 10–12 inches.

6. In combination of the free-standing ladder tool holder according to claim 3, wherein each of said front side sheet and said rear side sheet is substantially trapezoidal , and each of said right side sheet and said left side sheets is substantially rectangular.

7. In combination of the free-standing ladder tool holder according to claim 6, wherein said front side sheet, said rear side sheet, said right side sheet and said left side sheet are linearly attached at respective edges thereof.

8. In combination of the free-standing ladder tool holder according to claim 6, wherein at least one of said front side sheet, said rear side sheet, said right side sheet and said left side sheet are mounted so as to extend inward towards said handle so as to cover a portion of an edge of the top platform of a step-ladder when supported thereon.

9. In combination of the free-standing ladder tool holder according to claim 1, wherein said rear side sheet includes a first row of a plurality of elongated vertical pockets formed by a first sheet over the rear side sheet which is sewn to said rear side sheet at a plurality of vertically sewn portions.

10. The free-standing ladder tool holder according to claim 9, wherein said rear side sheet includes a second row of a plurality of pockets, which are wider than said elongated pockets, formed by a second sheet over the rear side sheet which is sewn to said rear side sheet at a plurality of vertically sewn portions and which overlaps said first sheet.

11. In combination of the free-standing ladder tool holder according to claim 1, wherein at least one of said left and right side sheets includes a clip for supporting a roll of tape.

12. In combination of the free-standing ladder tool holder according to claim 1, wherein at least one of said left and right side sheets includes a loop for supporting a large hammer or a drill.

13. In combination of the free-standing ladder tool holder according to claim 1, wherein at least one of said left and right side sheets includes a support which having a loop member which extends generally horizontally and support member which extends generally vertically below the loop member and attaches to the respective side sheet therebelow so as to be able to hold a tape measure therein.

14. A method of holding tools on a free-standing ladder, comprising the steps of:

a) providing a tool holder, comprising:

a skirt including a front side sheet, a rear side sheet, a left side sheet, and a right side sheet connected together at sides thereof to form a generally tubular structure having a top opening and a bottom opening;

said skirt narrowing towards the top thereof, and said top opening having a smaller size than said bottom opening;

said front side sheet, said rear side sheet, said right side sheet, and said left side sheet each being made of a substantially flat but flexible material;

at least one of said front side sheet, said rear side sheet, said right side sheet, and said left side sheet having at least one pocket for holding a tool;

said top opening being delineated by upper edges of each of said front side sheet, said rear side sheet, said right side sheet, and said left side sheet;

a handle extending across said top opening and attached to said upper edges of either said front side sheet, said rear side sheet, said right side sheet, and said left side sheet, at opposite sides of said top opening, said handle being made of a substantially flat but flexible material;

whereby when placed upon a free-standing ladder the top surface of the free-standing ladder can be exposed through the top opening and the handle can rest on a top platform of the free-standing ladder so that the top platform will remain unobstructed in normal use of the free-standing ladder;

b) providing a free-standing ladder having a hinged supporting frame topped with a top platform;

c) fitting said tool holder over the top platform of said free-standing ladder with a lower surface of said handle resting on an upper surface of said top platform; and d) placing at least one tool in said at least one pocket of the tool holder.

* * * * *